US006453594B1

(12) United States Patent
Griffin

(10) Patent No.: US 6,453,594 B1
(45) **Date of Patent: *Sep. 24, 2002**

(54) APPARATUS FOR ATTACHING A SUPPLEMENTAL DEVICE TO A MINIMALLY ALTERED HOST FIREARM

(75) Inventor: Todd Griffin, Miami, FL (US)

(73) Assignee: R/M Equipment, Inc., Miami, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/691,749

(22) Filed: Oct. 18, 2000

Related U.S. Application Data

(63) Continuation of application No. 09/152,231, filed on Sep. 11, 1998, now Pat. No. 6,134,823

(60) Provisional application No. 60/058,553, filed on Sep. 11, 1997.

(51) Int. Cl.[7] ..... F41C 27/06

(52) U.S. Cl. ..... 42/105; 42/85; 42/124

(58) Field of Search ..... 42/105, 85

(56) References Cited

U.S. PATENT DOCUMENTS

| | | | | | |
|---|---|---|---|---|---|
| 2,190,268 | A | * | 2/1940 | Magid | 42/85 |
| 2,330,737 | A | * | 9/1943 | Pedersen | 42/85 |
| 2,913,960 | A | * | 11/1959 | Harvey et al. | 42/85 |
| 3,680,240 | A | | 8/1972 | Barr et al. | 42/1 Q |
| 3,715,827 | A | * | 2/1973 | McKinzie | 42/85 |
| 3,967,402 | A | | 7/1976 | Cooksey | 42/10 |
| 4,539,769 | A | | 9/1985 | Stevens et al. | 42/1 A |
| 4,689,911 | A | | 9/1987 | White | 42/105 |
| 4,733,489 | A | * | 3/1988 | Kurak | 42/77 |
| 5,711,102 | A | * | 1/1998 | Plaster et al. | 42/85 |
| 5,848,491 | A | * | 12/1998 | Biemont | 42/85 |
| 5,930,935 | A | * | 8/1999 | Griffin | 42/105 |
| 6,134,823 | A | * | 10/2000 | Griffin | 42/105 |

FOREIGN PATENT DOCUMENTS

| | | | |
|---|---|---|---|
| CH | 388142 | 6/1965 | 42/105 |
| DE | 1901623 | 10/1969 | 42/105 |
| EP | 85193 | 8/1983 | 42/105 |
| EP | 342294 | 11/1989 | 42/105 |
| FR | 1282170 | 12/1961 | 42/105 |
| FR | 1520245 | 4/1968 | 42/105 |
| FR | 2253200 | 6/1975 | 42/105 |
| GB | 255232 | 10/1925 | 42/105 |
| GB | 2168795 | 6/1986 | 42/105 |
| WO | WO 93/13379 | 7/1993 | 42/105 |

* cited by examiner

*Primary Examiner*—David M. Mitchell
*Assistant Examiner*—Denise J Buckley
(74) *Attorney, Agent, or Firm*—Nawrocki, Rooney & Silvertson, P.A.

(57) ABSTRACT

An interbar assembly (34) for reversibly attaching a supplemental device, e.g., grenade launcher (32), to a host weapon, e.g., rifle (10). A preferred interbar assembly (34) attaches at its forward end to the rifle barrel (16), and at its rearward end to a "brace" (37) located in the breech area of the rifle (10). In a preferred embodiment, such connection can be made without the need for special tools after simply removing the host weapon lower hand guard (26*b*), which is readily removable, but without any other alterations.

1 Claim, 5 Drawing Sheets

APPARATUS FOR ATTACHING A SUPPLEMENTAL DEVICE TO A MINIMALLY ALTERED HOST FIREARM

CROSS REFERENCE TO RELATED APPLICATIONS

This is a regular application filed under 35 U.S.C. § 111(*a*) claiming priority, under 35 U.S.C. § 119(e)(1), of provisional application Serial No. 60/058,553 previously filed Sep. 11, 1997, under 35 U.S.C. § 111(*b*).

TECHNICAL FIELD

This is a continuation of Application Ser. No. 09/152,231 filed on Sep. 11, 1998, now Pat. 6,134,823 which is a continuation of Provisional Application Serial No. 60/058,553, filed on Sep. 11, 1997.

The-present invention relates broadly to the field of firearms. More narrowly, the invention relates to rifle technologies and to specifics of that field dealing with attaching supplemental devices, e.g. grenade launchers, to such weapons.

BACKGROUND OF THE INVENTION

As warfare has progressed through the ages, weapons more and more sophisticate & have evolved. Of course, weapons have become more powerful and accurate. And they have also become more compact, more reliable, lighter weight and easier to operate, to maximize their overall effectiveness. But most weapons, even modem weapons, are "dedicated" in the sense that they are capable of delivering only one type of projectile. The present invention relates to reversibly configuring a single hand-held weapon such that it is capable of delivering multiple types of projectiles. More particularly, the present invention relates to quick attaching/detaching a supplemental launching device, preferably a grenade launcher, to an automatic rifle such as an M16, thus increasing the versatility and effectiveness of the M16; and doing so in such a way that only minimal no-tool changes are required to enable the M16 to accept the supplemental device.

It should be noted that a commonly-assigned copending application discloses a method and apparatus for attaching a supplemental device to a host weapon that is not altered in any material way. In fact, in the most preferred embodiment of that copending application, no changes at all need to be made to the host weapon prior to attaching to it the supplemental device. While that approach has many advantages, Applicant pereves that another highly advantageous approach is to slightly alter or reconfigure the host weapon in the field, without the need for tools, threaded fasteners, etc., prior to attaching the supplemental device to the host weapon. The present invention relates to the "slight alteration" approach, and those skilled in the art will appreciate that this approach has its own advantages, depending on the desired characteristics of the host weapon and the host/supplemental device combination. These advantages are discussed at length below.

As noted above, the present invention relates primarily to automatic or semiautomatic or assault rifles. The automatic rifle is a weapon that can fire a number of rounds in quick succession. Such operation is accomplished in view of the fact that the functions of firing and reloading are performed by the weapon itself. These functions include firing the cartridge, withdrawing the bolt, ejecting the spent cartridge case, cocking the hammer, forcing the bolt forward, and inserting a fresh cartridge into the chamber ready to fire. The energy for performing these functions is provided in one of two ways: by the pressure of the gas produced by the firing of the cartridges (in gas operated weapons) or by the recoil of the weapon itself. The M16 is one particularly effective type of automatic rifle, and the present invention will be described with the M16 as an example; but those skilled in the art will understand that in no way is the invention limited to the M16.

Another type of weapon which has altered the face of conventional warfare is the grenade launcher. The M79 grenade launcher is a shoulder fired weapon which has been used by the U.S. Army now for some time. While the effectiveness of hand-thrown grenades is limited in both distance and accuracy, weapons such as the M79 improve the accuracy with which a grenade can be projected and certainly greatly extend the distance over which grenades can be projected.

The M79 grenade launcher is a dedicated weapon. That is, it is used for one purpose and not in combination with other weapons.

More recently, the M203 grenade launcher has been developed and implemented as a weapon system in the arsenal of the armed forces of the United States. The M203 is the successor of the M79. The desirability of the M203 as compared to the M79 sides in the fact that it fulfills a requirement for a rifle/grenade launcher package, whereas the M79 was only a dedicated grenade launcher. The M203 is a weapon system that, when operational, is attached to an M16 rifle. Although relatively light in weight, it nevertheless does add some additional weight to the rifle with which it is used. Optimally, the weapon carried by an infantry soldier should be as light as possible at any particular time.

The prior art includes various techniques for reversibly configuring an M16 rifle to accept a M203 style grenade launcher. One such technique is disclosed in commonly-assigned U.S. Pat. No. 4,733,489. The '489 technique involved the clamping of an "upper rack" to the underside of the barrel of an M16, using threaded fasteners or the like. A "lower rack" was secured to the upper surface of a M203 grenade launcher, also using threaded fasteners or the like. The upper and lower racks were designed to be easily and quickly connected and disconnected to one another in the field, thereby reversibly connecting the grenade launcher to the rifle, without the need for tools or threaded fasteners. The '489 technique was advantageous over previous techniques in that the lower and upper racks, respectively, could be assembled to the grenade launcher and rifle well ahead of time. In the field, then, all that was required was for the operator to make a quick, no-tools connection of the lower rack/grenade launcher assembly to the upper rack/rifle assembly. The only disadvantage of the '489 approach, as perceived by Applicant, is that the '489 technique requires either that the upper rack be attached to the rifle in the field, a process that can take several minutes and require tools and the handling of small threaded fasteners; or that the upper rack be pre-installed, which then results in an increase in the weight of the M16, as well as a change in the balance of the weapon.

In a preferred embodiment, the present invention is an apparatus for allowing selective and rapid configuration and reconfiguration of an automatic rifle as a grenade launcher, wherein there is no need to pre-install an upper rack or the like on the rifle and wherein the entire rack or bar assembly, sometimes called the "interbar," can be attached to or integral with the grenade launcher; and wherein the grenade launcher/interbar combination can be quickly and easily reversibly attached to a minimally altered rifle in the field, without the need for tools. As such, the present invention solves problems existent in the prior art and satisfies requirements dictated by the need for light weight and efficient, easy-to-use weapon systems.

Applicant has also perceived another potential problem with prior art techniques for attaching a supplemental device, e.g., a grenade launcher assembly, to a rifle, relating to the sling strap of the rifle. In the past, when a grenade launcher was attached to a host weapon, the forward sling strap attachment would have to be modified to move the strap out of the trajectory of the grenade launcher. Usually this was done by the addition of a supplemental forward sling strap attachment point, using tools, on the host weapon itself. Alternatively, operators often improvised various informal ways of attaching the sling strap to the host. One aspect of the present invention obviates the need for modifying the host weapon, or informal modifications of the sling strap in the field.

Finally, Applicant has perceived the need for a sight on a combination host weapon/supplemental device (e.g., automatic rifle/grenade launcher) for the supplemental device, without requiring modification of the host weapon or the use of tools or the like. A preferred such sight would be easily adjustable, usable on either side of the weapon, and be easily and ambidextrously adjustable for windage and elevation, preferably without the need for special tools that may not be readily available in the field. One aspect of the present invention addresses this need as well.

Thus, the present invention addresses the problems discussed above with prior art weapons. In particular and in its most preferred embodiment, the present invention provides a method and apparatus for quickly and easily attaching a supplemental device such as a grenade launcher to a host weapon such as an automatic rifle, with only minimal alteration of the host weapon (that is, prior to the supplemental device being attached); a technique for handling the sling strap of a host weapon when a supplemental device is attached; and a way to provide a sight for the supplemental device without having to permanently modify the host weapon.

SUMMARY OF THE INVENTION

One aspect of the present invention is an interbar assembly for reversibly attaching a supplemental device (e.g., grenade launcher) to a host weapon (e.g., M16 rifle) having a barrel, a breech bracing structure and a removable lower hand guard. The interbar assembly in this embodiment of the present invention includes an elongated interbar carrying the supplemental device; an interbar front mount that reversibly connects to the host barrel after removing the lower hand guard; and an interbar rear mount that reversibly engages the breech bracing structure also after removing the lower hand guard, whereby the interbar assembly and the supplemental device are secured to the host weapon. In this particular embodiment, the interbar is not integral with the supplemental device, and the two are connected together, preferably using threaded fasteners.

Another aspect of the present invention is a system for attaching a supplemental device assembly to a host weapon having a breech bracing structure, a barrel and a removable lower hand guard. The system includes a supplemental device assembly front mount for connecting to the barrel, upon removal of the lower hand guard; and a supplemental device assembly rear mount for engaging the breech bracing structure upon removal of the lower hand guard, whereby the supplemental device assembly is secured to the host weapon. The supplemental device assembly can include a supplemental device such as a grenade launcher and an interbar, and the host weapon can be an M16 rifle or any other combat rifle or carbine.

Additional embodiments, aspects, and features of the present invention are discussed below with reference to the attached drawings.

DETAILED DESCRIPTION OF PREFERRED EMBODIMENT

Figure 1:
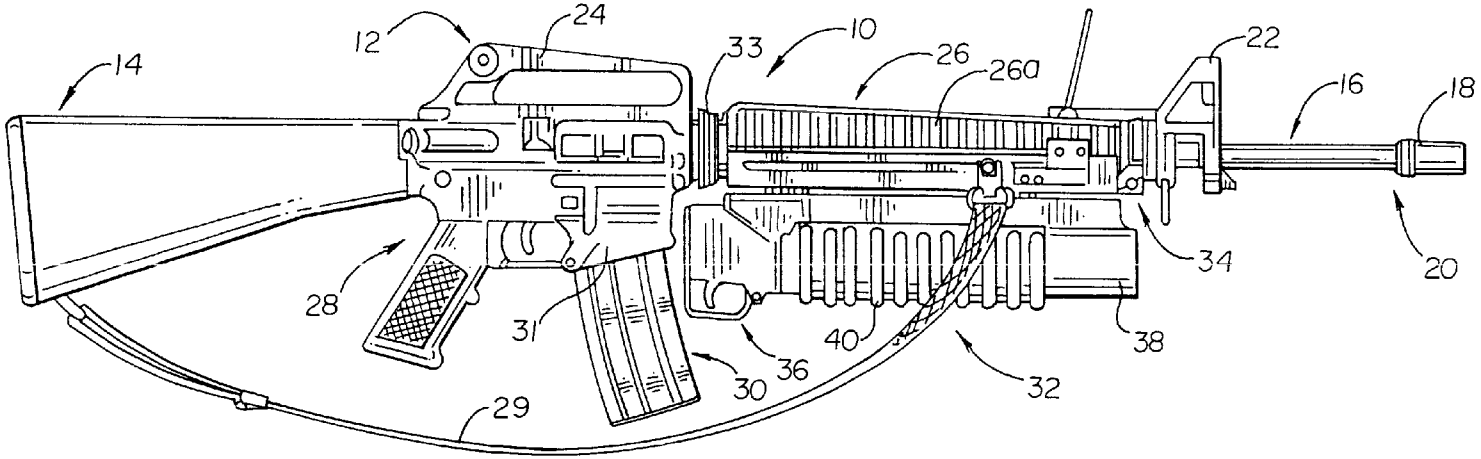
FIG. 1 is a right side elevational view of an automatic rifle reconfigured accordance with the present apparatus inventions, and with a grenade launching device attached thereto by means of an interbar assembly.
Figure 2:
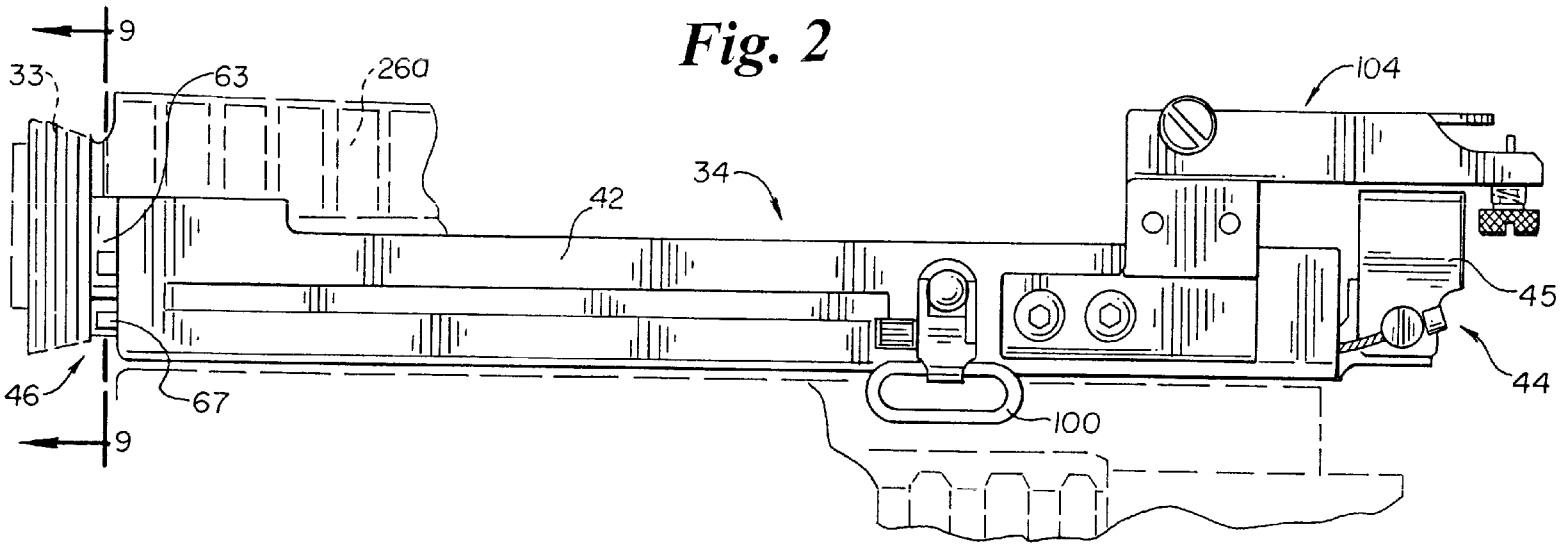
FIG. 2 is an enlarged right side elevational view of the interbar assembly in accordance with the present invention, with the host weapon and supplemental device in phantom.
Figure 4:
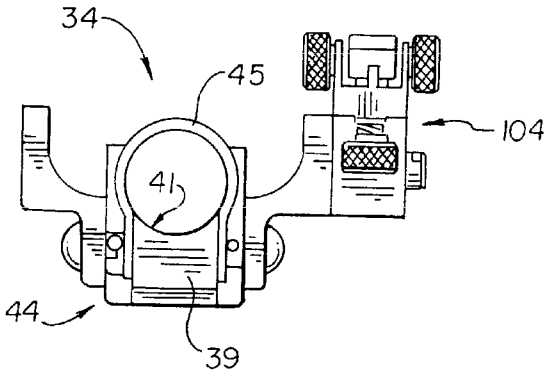
FIG. 4 is an enlarged end elevational view of the interbar assembly front mount.
Figure 3:
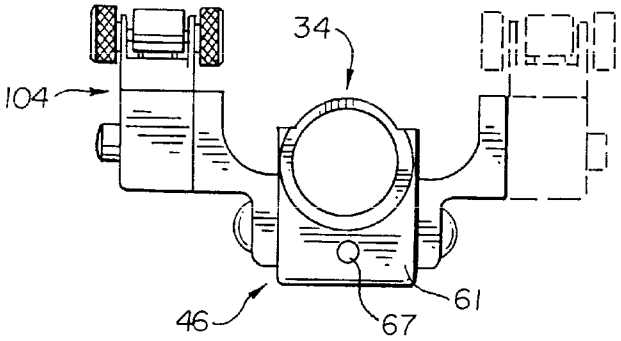
FIG. 3 is an enlarged end elevational view of the interbar assembly rear mount.
Figure 5:
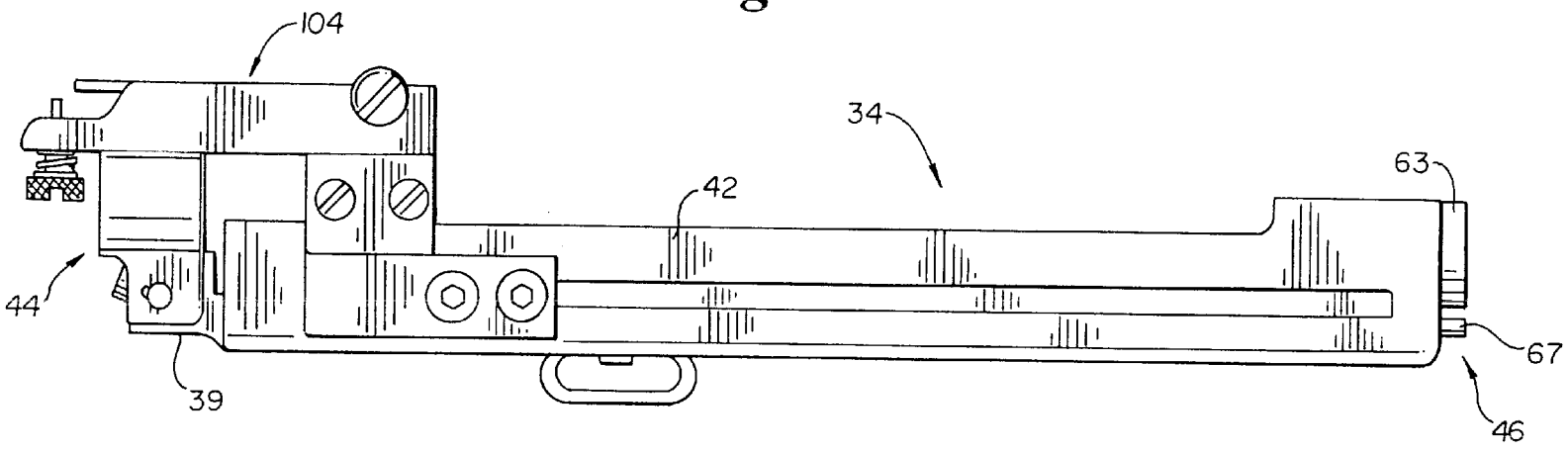
FIG. 5 is an enlarged left side elevational view of the interbar assembly in accordance with the present invention, with the host weapon and supplemental device removed.
Figure 6:
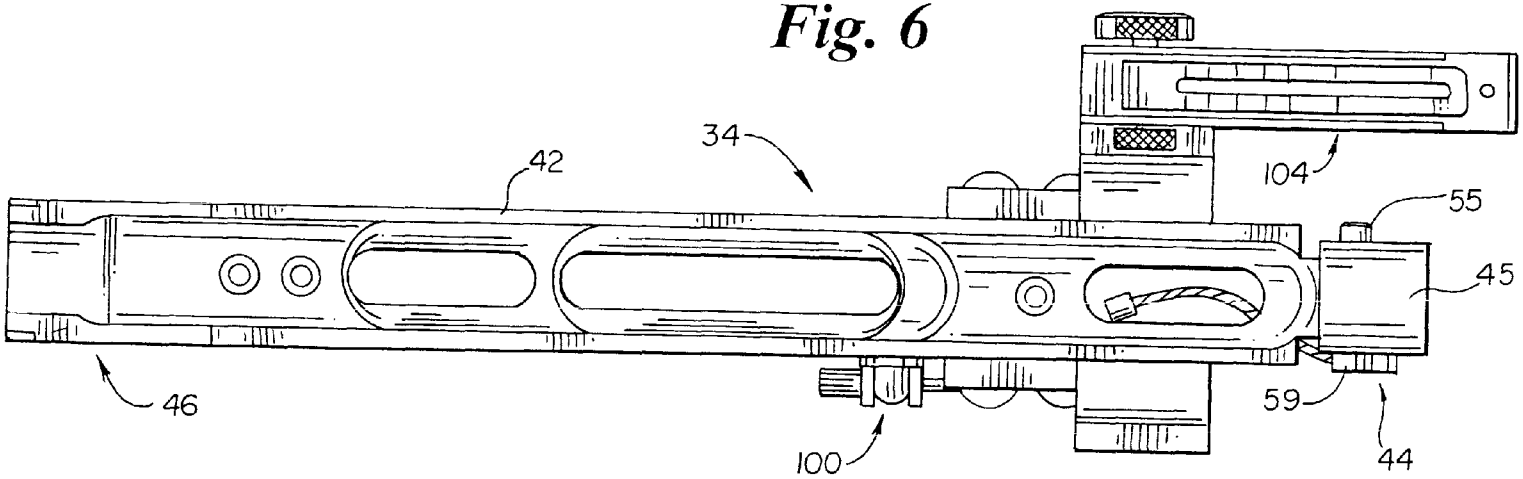
FIG. 6 is a top plan view of the interbar assembly in accordance with present invention, with the host weapon and supplemental device removed.
Figure 7:
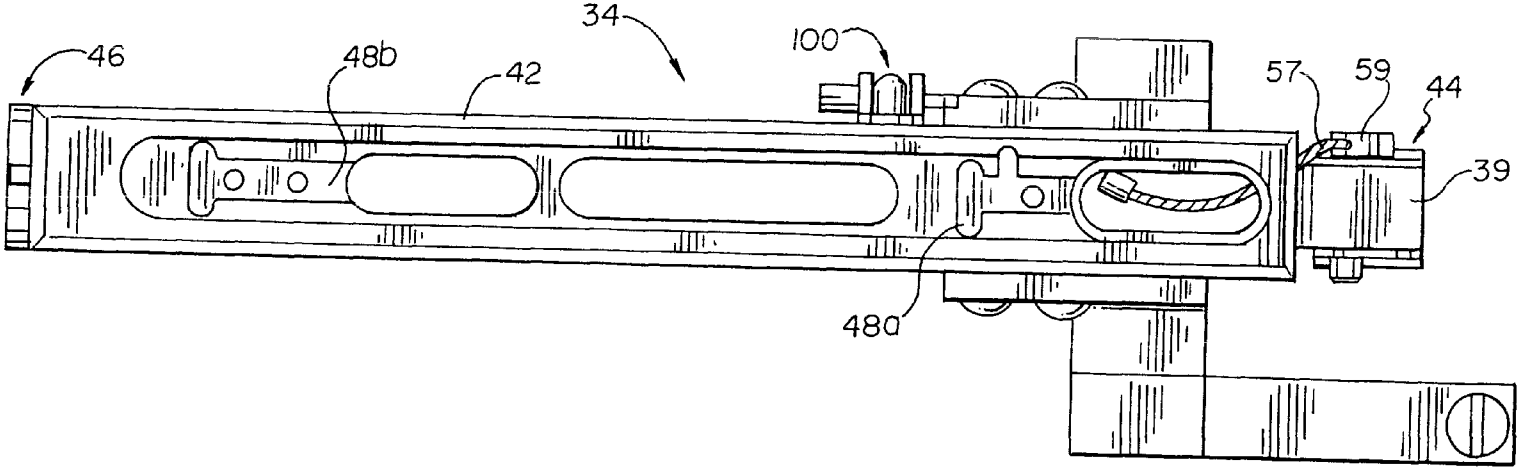
FIG. 7 is a bottom plan view of the interbar assembly in accordance with present invention, with the host weapon and supplemental device removed.

Referring now to the drawings wherein like reference numerals denote like elements throughout the several views, FIG. 1 illustrates an automatic rifle 10 carrying a grenade launcher 32. Rifle 10 is sometimes referred to as the "host firearm" or "host weapon" or "host" herein. Grenade launcher 32 is sometimes referred to as the "supplemental device" herein, and while other types of supplemental devices and grenade launchers are contemplated, the preferred such device is an M203 style grenade launcher.

During the course of the following discussion, reference is occasionally made to such descriptions as horizontal, vertical, top, bottom, front, rear, etc. Such descriptions assume, unless stated or implied otherwise, that host weapon 10 is oriented as shown in FIG. 1, i.e., in such a way that the barrel is horizontal and the weapon is in its normal, upright orientation as during normal use. The "right" side of weapon 10 is the visible elected in FIG. 1.

Rifle 10, a preferred host firearm, includes a central breech portion 12, a butt 14 extending rearwardly from the breech portion 12, a barrel 16, having a flash arrester 18 at the forward end 20 thereof, extending forwardly from the breech portion 12, a forward sight 22, a transport handle 24 which includes a rear sight (not shown), a hand guard 26 intermediate the forward sight 22 and the transport handle 24, a grip 27 and trigger assembly 28, a sling strap 29, and a magazine 30 including a magazine well 31.

The forward sight 22 is illustrated at its location proximate the barrel forward end 20, and an annular spring-loaded collar 33 is shown at an opposite end of the barrel 16. This collar 33 is used for holding the hand guard 26 in place. Hand guard 26 surrounds barrel 16 between collar 33 and sight 22 on this particular rifle. And hand guard 26 is actually a clam shell design made up of an upper hand guard portion 26*a* and a lower hand guard portion 26*b*, which for an M16 are identical parts, that join together along a generally horizontal plane that bisects barrel 16.

Each hand guard portion 26*a* or 26*b* includes a high strength plastic outer shell and a metal heat shield inner shell. The plastic outer shell is ribbed to provide a gripping surface. And the plastic outer shell also forms tabs or axially extending elements at each end thereof, so as to assist in retaining the hand guard in secure position, unless it is desired to remove it. The front tabs or extensions of each hand guard portion 26*a* or 26*b* engage the outer and inner surfaces of a rearwardly facing metal stationary ring 35 which surrounds barrel 16 immediately adjacent to the rearmost extent of forward sight 22. The rear tabs or extension of hand guard portions 26*a* and 26*b* fit beneath and are locked in place by annular collar 33. When it is desired to remove either or both hand guard portions, which can be removed or left intact completely independent of one another, the operator pushes annular collar 33 toward the butt of rifle 10 against the force produced by a compression spring (not shown) bearing against the butt side of annular collar 33. When collar 33 has been pushed rearwardly a sufficient distance, either or both hand guard portions 26*a* or 26*b* can be removed simply by pivoting the rear portion of the hand guard out and away from the barrel 16. Once the hand guard portion(s) is clear of the annular collar, the collar 33 can be released, with its spring again urging it toward its normal position.

Figure 9:
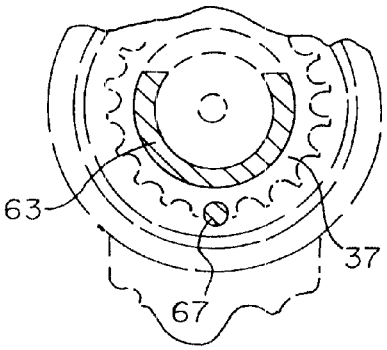
FIG. 9 is an enlarged sectional view taken generally along the line 9—9 of FIG. 2, showing how the rear mount interconnects with the host weapon.
Figure 8:
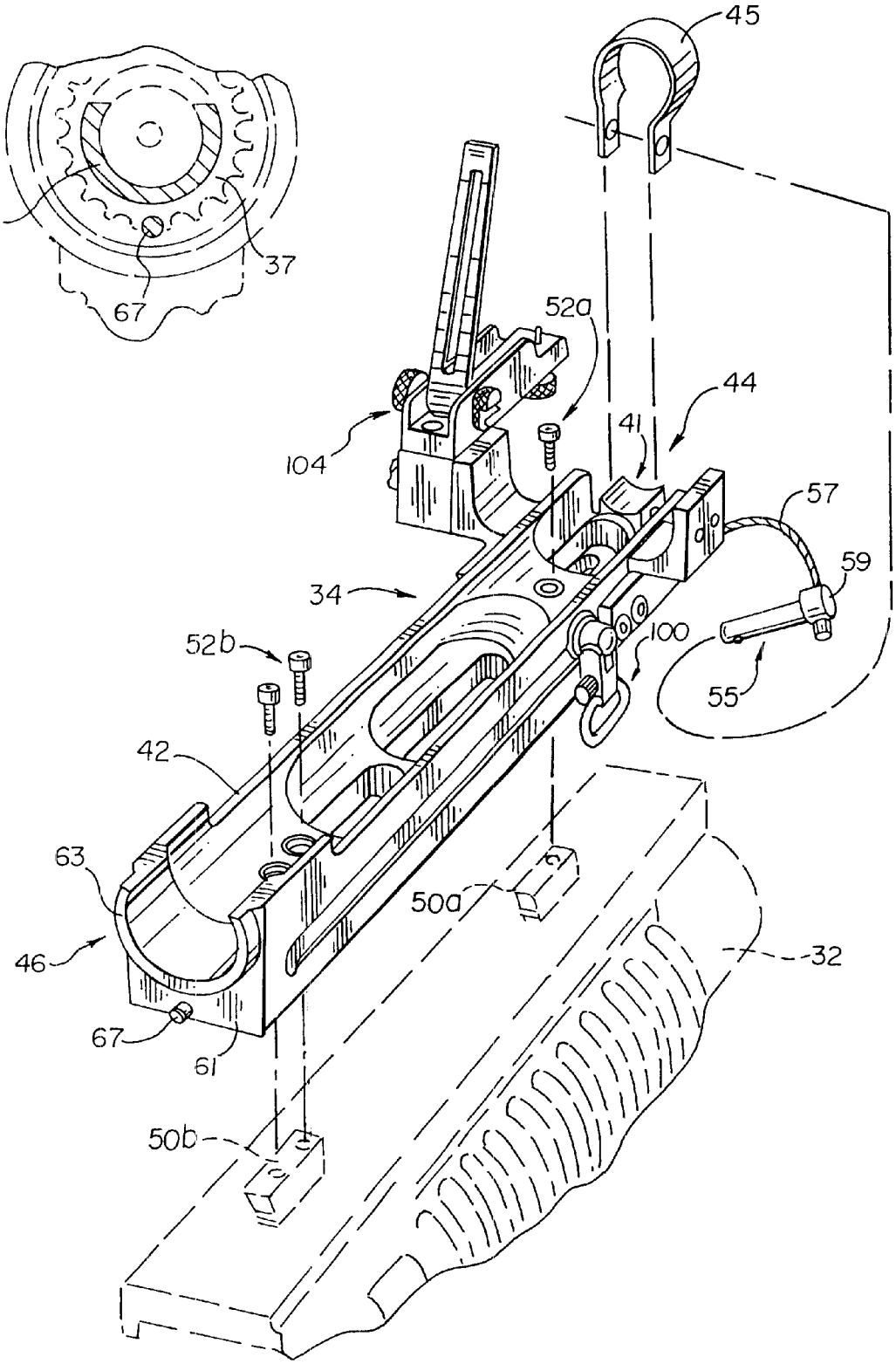
FIG. 8 is an exploded perspective view illustrating how various component parts of the present apparatus invention are arranged and assembled.

Annular collar 33 eventually hits a forward "stop" that prevents it from moving any further toward the front of the barrel. This stop is established by a relatively thin, serrated gear-like "brace" 37 shown in FIG. 9. Brace 37 has a smooth inner surface that is axially rigidly secured to barrel 16, and an exterior surface that forms a series of semi-circular cutouts circumferentially arranged around the entire circumference of brace 37, again in the nature of a gear or the like. With reference to FIG. 9, brace 37 also forms, in conjunction with barrel 16, an annular groove 65. The significance of annular collar 33, ring 35, groove 65 and brace 37 to a preferred embodiment of the present invention will be discussed at length below.

Attached to rifle 10, as depicted in FIG. 1, is a "supplemental device," preferably grenade launcher 32, and most preferably an M203 style grenade launcher. The grenade launcher 32 is mated to rifle 10, preferably to the barrel 16 of same. The connection is made proximate the rifle hand guard area, and it is made by use of an apparatus according to the present invention, called an "interbar assembly," and designated generally herein with reference numeral 34. The grenade launcher 32, connected to and suspended from the interbar assembly 34, includes a trigger mechanism portion 36, a barrel 38, and its own hand guard 40 encircling a portion of the barrel 38.

An important aspect of the present invention relates to the interbar assembly 34, and particularly to the way in which the interbar assembly 34 (and the supplemental device 32 carried with or by interbar assembly 34) attaches to rifle 10 or other host firearm. It should be emphasized that the interbar assembly 34 can be joined to launcher 32 using threaded fasteners or the like, as shown and described herein as a preferred embodiment; but the interbar assembly 34 can also be permanently attached to or even integral with the grenade launcher 32. For example, and not by way of limitation, an interbar assembly according to the present invention could actually be an integral part of the barrel of the grenade launcher or other supplemental device. Or the interbar assembly could be welded, for example, to the supplemental device. The present invention is not limited to any particular interbar/supplemental device connection or integration scheme.

Referring primarily to FIGS. 2, 5, 6, 7 and 8, interbar assembly 34 includes an elongated bar 42, preferably constructed from a high strength metal such as steel. Bar 42 may be fabricated in various ways, for example by milling and drilling bar stock. Attached at the forward end of bar 42 is a front mount 44; and attached at the rearward end of bar 42 is a rear mount 46. Mounts 44 and 46 will be discussed in detail below, as they are the attachment points between the interbar assembly 34 and the host weapon 10.

Prior to describing mounts 44 and 46 in detail, bar 42 will be further described. Bar 42 forms a pair of grooves 48*a* and 48*b* suitable for accepting pylons 50*a* and 50*b* (see FIG. 8)extending upwardly from the barrel of a grenade launcher or other supplemental device. Once the pylons 50*a* and 50*b* are positioned within the grooves 48 threaded fasteners 52*a* and 52*b* are used to vertically secure interbar 42 to the pylons 50*a* and 50*b*. See FLAG. 8, noting that an "a" following a given reference numeral indicates that the component, etc. is located toward the forward end of bar 42. This attachment technique, or one very similar to this, is disclosed in U.S. Pat. No. 4,733,489, incorporated herein by reference, but in the case of the '489 patent the technique is used to attach a grenade launcher to a "lower rack" rather than to an entire interbar such as interbar 42. It should be recognized, however, that any suitable connection technique between the supplemental device and interbar 42 could be used. In fact, as discussed above, an interbar structure could actually be affixed to the supplemental device in any number of ways, or even be integral with and not separate from the supplemental device. Importantly, the process of attaching the supplemental device to the interbar assembly, whichever attachment technique is employed, would preferably be completed well prior to active field activities, so that operators would not be required to deal with tools, threaded fasteners, and the like during active field operations.

Attention can now be turned to front mount 44. Front mount 44 includes a generally cube-shaped block 39 that is connected to the very front end of bar 42, and extends forwardly relative thereto. Preferably, block 39 is integral with the main portion of bar 42, having been machined from a single piece of high strength metal. But of course block 39 could be separately fabricated and then fastened to the front edge or face of bar 42 using fasteners or the like. Block 39 is square and flat on all of its surfaces except its top surface, which forms a curved surface 41 compatible with the portion of the host weapon barrel it is intended to interface with, as further described below. Also, block 39 is drilled through side-to-side, to form a thru hole 43. A pendant coupling ring 45, sometimes referred to as the "PCR" herein, slidably engages the flat, vertical sides of block 39. Ring 45, in the nature of a steel formed piece, has a generally circular upper portion 47 that has a radius very comparable to that of the upper surface of block 39, also so that it may conform to the surface of the portion of the barrel of the host weapon it is intended to interface with. Ring 45 also has a lower portion in the nature of a pair of parallel, vertical (when installed on block 39) ears 49 spaced apart roughly the side-to-side width of block 39. Ears 49 are drilled thru like block 39 to form a pair of holes 51, which align with block hole 43 when the ring 45 is installed thereon.

It should be noted that the PCR 45 is not symmetrical when viewed from the side. It has a shape reminiscent of a bonnet, vertically flat on one face, and forming a cutout on the opposite face 53. This causes the PCR 45 to be broader toward its top, and narrower toward its bottom, when viewed from the side (see FIG. 8).

Another component of front mount 44 is an alignment retention and locking pin ("ALRP") 55. ALRP 55 fits through block hole 43 and PCR holes 51 when the block and PCR are appropriately positioned relative to one another, and the ALRP 55 completes the assembly. The ALRP is a steel pin having an enlarged head 55 at one end and a spring-loaded stainless steel captive ball detent 60 at the opposite end. The detent precludes accidental withdrawal of the ALRP from its engagement and mating position, ensuring the operator that the launcher 32 is always ready for use. That is, the detent ball ends up on the outside of the PCR after insertion, so in order to pull the pin out of the holes in block 39 and the PCR, it is first necessary to overcome the resistance provided by the spring acting on the detent ball.

The pin or ALRP 55 is held captive to the bar 42 by means of a Teflon-covered, stranded, stainless steel, wire "rope" 57, which is crimped on both ends to retain it and pin 55 to the bar 42. An enlarged head 59 of pin 55 is drilled thru to accept rope 57. The rope is the appropriate length to provide some slack so the operator can appropriately position pin 55, but is short enough to in effect pre-position the pin 55 in the general area of the holes in the block and PCR (when assembled together), so as to assure the operator that the ALRP will not be lost during periods of disengagement and handling. This feature is especially critical when performing the engagement/disengagement activity in the dark or with gloves. Excess retaining rope 57 after insertion and alignment can be stored in a pocket or cutout formed in the bar 42, possibly especially for this purpose, as the hole(s) that accept rope 57 are sufficiently large in diameter to allow the rope 57 to slide easily therethrough, but without permitting the crimps to pass through.

Attention is now turned to the rear mount 46. Rear mount 46, like front mount 44, is also in the general nature of a block having square, flat surfaces except for the top surface, which is semi-circular to accept the corresponding portion of the host weapon barrel. The rear mount 46, unlike front mount 44, does not include a PCR or the like, as the rear mount is actually retained by the annular groove 65 created by the barrel itself, on the inside, and a radially spaced surface formed by brace 37, on the outside. More specifically, extending rearwardly from a rear face 61 of bar 42 is a semi-circular, upwardly facing extension 63. Extension 63 is sized and configured to mate very precisely with groove 65, so as to retain the rearward end of bar 42 against rearward axial movement or downward movement. And the barrel itself, as discussed below, helps prevent bar 42 from moving forwardly so as to permit extension 63 from escaping groove 65. This means that rear mount 46 can be extremely simple and light weight, since it relies, in this preferred embodiment, on the relatively complex brace 37 (and related parts) to retain it to the host weapon. This minimizes the weight of interbar assembly 34, and reduces the number of moving parts to an absolute minimum.

Rear mount 46 also includes an axially aligned pin 67 that extends rearwardly out of face 61, just below the curved upper surface thereof. Pin 67 is positioned in just the right place on bar 42 to engage one of the cutouts in serrated brace 37, preferably the cutout at the very bottom of the brace 37, i.e., at the "6 o'clock" position. See FIG. 9. Pin 67, since it is captured within one of the cutouts in brace 37, prevents unwanted rotation of the interbar assembly 34 and supplemental device 32 relative to the host weapon 10. Brace 37 also provides axial bracing for interbar 42, to help absorb the recoil forces generated upon firing the supplemental weapon.

So it can be seen that the rear mount 46 interacts with brace 37 to brace interbar assembly 34 against rifle 10, and help prevent rearward or rotational relative movement therebetween. And the M16 barrel itself, due the manner in which it necks down to a smaller diameter in the hand guard area, helps prevent unwanted forward movement of the interbar assembly 34 relative to the host weapon 10. Importantly, the present invention contemplates that the rear of the interbar assembly 34 could be braced against any suitable structure located in the breech area (herein referred to as "breech bracing structure") depending on a variety of factors, e.g., the exact configuration of the host weapon.

While brace 37 may not be the only "breech bracing structure" that a rear mount could interface with, it is the preferred such structure. The advantages of retaining the rear mount in the manner described above are many. As noted above, the assembly can be so simple, because it relies on components (e.g., brace 37 and barrel 16) already present on the host weapon. This simplicity results in an elegant design that minimizes weight and maximizes reliability and ease of use.

A preferred interbar assembly 34 also includes a supplemental sling strap attachment point 100, sometimes referred to herein as a SSSAP. When any supplemental device is attached to a host weapon, the forward sling strap attachment must be modified to move the sling out of the trajectory of the projectile, e.g., grenade. Usually this is done by the addition of a supplemental sling strap attachment point on the host weapon itself, using tools. Lacking a supplemental sling strap attachment point on the host, operators often improvise an informal method of attaching the strap to the host firearm. This can cause safety or reliability problems. The present invention includes a SSSAP 100 on the interbar assembly 34, so that no modification of the host is necessary, or informal field "solutions." The SSSAP 100, as part of the interbar assembly 34, or as part of a supplemental device/interbar assembly combination as discussed at length above, precludes the need to further modify the host weapon or for improvisation by the operator Strap 29 is simply moved from the normal host attachment point 102 (see FIG. 1)to the SSSAP 100 by the operator, quickly and without tools.

A preferred interbar assembly 34, or interbar/supplemental device combination, also includes a supplemental device sight 104. A preferred sight 104 is a folding-blade leaf sight designed for mounting on either the left or right side of the interbar assembly 34. Leaf sight 104 can be easily operated by one hand for all adjustments. The adjustments for windage and elevation are ambidextrous. The sight can be moved to the opposite side of the interbar assembly 34 by the operator quickly, easily and without the need for tools, to accommodate the operator's dominant eye. A preferred embodiment of sight 104 is secured to. the interbar assembly by screws, but a standard 40 mm cartridge case rim can be used to loosen and tighten the sight block retaining screws which allow the repositioning of the sight from side to side.

In the case where the "supplemental device" is a grenade launcher, a preferred sight 104 is functional from 100 to 400 meters and is graduated in 50 meter increments. 100 meter marks can be identified by the number of dots representing the range in hundreds of meters. Dot markings allow the system to easily be used by operators familiar only with Arabic numerals.

In operation, the supplemental device, e.g., grenade launcher 32, is connected to the interbar assembly 34 using threaded fasteners 52*a* and 52*b* or the like. Or, as discussed repeatedly above, the interbar assembly Scan actually be part of or integral with the supplemental device. Then, if desired, a supplemental device sight 104 can be secured to the interbar assembly, to the right or left depending on the operator's dominant eye. Importantly, these steps can be taken before going out into the field. The host weapon 10, prior to attachment of the supplemental device,is preferably not materially modified (and most preferably not modified in any way whatsoever), so its weight is not increased, its balance is not detrimentally affected, and its effectiveness as a dedicated single-purpose weapon is not diminished in any way.

Figure 10A:
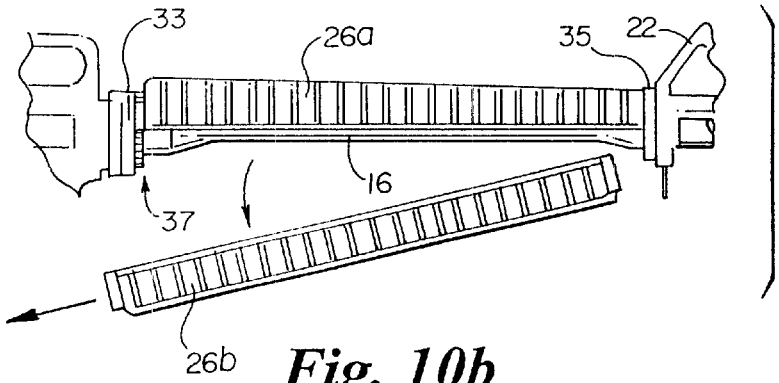
FIGS. 10A–10D illustrate the steps involved in connecting the interbar assembly to the host weapon.
Figure 10B:
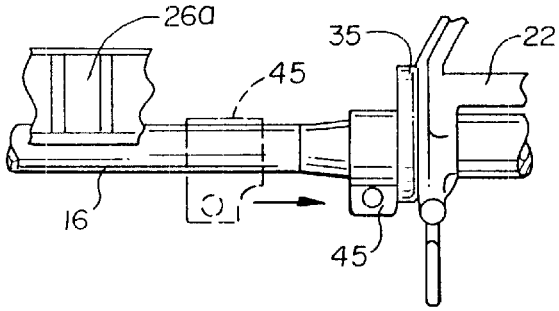
Figure 10C:
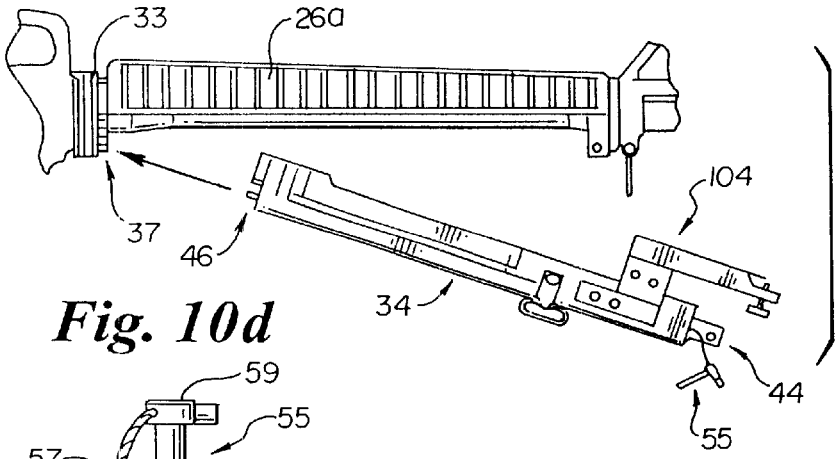
Figure 10D:
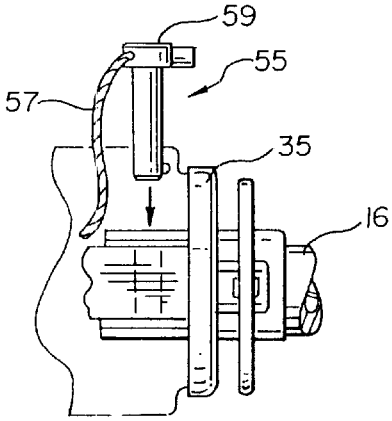

The remaining steps are typically though not necessarily taken in the field, and these are depicted in FIGS. 10A–10D. When it is desired to attach the supplemental device (e.g., grenade launcher 32) to the host weapon (e.g., rifle 10), the sling strap 29 of the host weapon is preferably disconnected from its normal attachment point 102 at the forward end of the barrel. The pin 55 is removed from the PCR 45 and the front block 39, and the PCR 45 disengaged from the block (to accommodate the barrel of the host weapon). Then, the spring-loaded collar 33 is engaged to release the lower hand guard portion 26*b*, and the hand guard is set aside or stored for future use. Next, the pendant ring 45 is positioned on the barrel 16 as shown in FIG. 10B, with its cutout face 53 facing forward so that the front of the "bonnet" actually resides beneath the rearward facing lip in the ring 35 adjacent front sight 22. The interbar assembly/supplemental device assembly is then positioned below the barrel 16 of rifle 10 so as to slide the rear mount extension 63 into and within groove 65 in brace 37 and to slide pin 67 into the "6 o'clock" cutout in serrated brace 37. Then, the curved top surface 41 of front mount block 38 is placed against the host weapon barrel 16, the PCR 45 is placed into engagement with block 39 such that the parts' respective holes align. The pin 55 is then inserted until the detent 60 snaps in place, and excess wire rope can be slid into a pocket in interbar 42. Barrel 16 necks down to a smaller diameter in the hand guard area, and interbar assembly 34 in essence resides in that necked-down area; thus this helps prevent assembly 34 from moving axially forward so as to free extension 63 from the confines of groove 65. The interbar assembly, including the supplemental device, is at that point locked to the host weapon. The resulting weapon is dualpurpose, and the interconnection between the host and supplemental weapon is simple, easy to use, does not require any tools to accomplish, and adds very little weight to the overall weapon.

Once the supplemental device is secured to the host, it is simply a matter of attaching the sling strap 29 to the SSSAP 100 and adjusting the sight 104. If it is necessary to relocate the sight to the other side of the interbar assembly, a 40 mm casing rim can be used to unscrew the threaded fasteners, and then screw them in again once the sight has been relocated to the other side.

Detaching the supplemental device is very simple. The sling strap 29 is removed from the SSSAP 100; the pin 55 is removed by overcoming the detent force; the PCR is disengaged from block 39; and the bar 42 is pivoted and moved forwardly relative to host weapon 10, to move forward block 39 away from barrel 16 and to draw the rear extension 63 and pin 67 out of their respective portions of brace 37 on the host weapon. The lower hand grip 26*b* can then be reattached through manipulation of annular collar 33, and the sling strap 29 reattached to its primary attachment point 102 on the barrel of the host. Following those simple steps, the host is once again in its original configuration, with no extra weight and optimized for dedicated use as a precision, single-purpose firearm. Thus, the supplemental device is "reversibly attached" to the host weapon in the sense that it can be readily attached to the host and then readily detached as well.

Numerous characteristics and advantages of the invention covered by this document have been set forth in the foregoing description. It will be understood, however, that this disclosure is, in many respects, only illustrative. Changes may be made in details, particularly in matters of shape, size, and arrangement of parts without exceeding the scope of the invention. The invention's scope is, of course, defined in the language in which the appended claims are expressed.

What is claimed is:

1. Apparatus for reversibly attaching a supplemental device to a host weapon having a barrel, a breech bracing structure, an upper hand guard and a replaceable lower hand guard, comprising:

(a) an elongated interbar for carrying the supplemental device, said interbar having a front end, a rear end and a sling strap attachment point positioned between said front end and said rear end;

(b) a front mount attached to said front end of said interbar, said front mount being constructed and arranged to connect to the host weapon barrel upon substitution of said interbar for said replaceable lower hand guard; and (c) a rear mount attached to said rear end of said interbar, said rear mount being constructed and arranged to operatively engage the breech bracing structure upon substitution of said interbar for said replaceable lower hand guard, whereby said apparatus and the supplemental device are secured to the host weapon.

* * * * *